United States Patent [19]

Vandame

[11] Patent Number: 4,795,369

[45] Date of Patent: Jan. 3, 1989

[54] ELECTRICAL CONNECTOR APPARATUS FOR A LOUDSPEAKER MOTOR

[75] Inventor: Bertrand Vandame, Villepreux, France

[73] Assignee: Precision Mecanique Labinal, Bois D'Arcy, France

[21] Appl. No.: 75,950

[22] Filed: Jul. 21, 1987

[30] Foreign Application Priority Data

Jul. 28, 1986 [FR] France ..... 86 10887

[51] Int. Cl.[4] ..... H01R 13/62

[52] U.S. Cl. ..... 439/544

[58] Field of Search ..... 439/529, 533, 540, 544, 439/545, 568, 569, 571, 572, 577

[56] References Cited

U.S. PATENT DOCUMENTS 3,510,937 5/1970 Heppner et al. .

3,954,318 5/1976 Larson et al. ..... 439/544

4,068,103 1/1978 King et al. .

4,352,538 10/1982 Fowler ..... 439/544

4,592,611 6/1986 Fritschke ..... 439/544

FOREIGN PATENT DOCUMENTS 2119202 4/1982 United Kingdom .

*Primary Examiner*—Joseph H. McGlynn

*Attorney, Agent, or Firm*—Sandler & Greenblum

[57] ABSTRACT

An electrical connector adapted to cooperate with a loudspeaker includes a body formed into a socket having at least two contact bars for connection to a motor of the loudspeaker, and at least one projection having a bearing surface adapted to abut against the bowl of the speaker and at least two elastic clamps including a shoulder adapted to interact with edges of corresponding openings in the speaker bowl.

53 Claims, 3 Drawing Sheets

ELECTRICAL CONNECTOR APPARATUS FOR A LOUDSPEAKER MOTOR

BACKGROUND OF THE INVENTION

1. Field of the Invention

The present invention relates to an electrical connector apparatus. More specifically, the present invention is directed to an electrical connector for connection to a motor of a loudspeaker including a bowl supporting a diaphragm.

2. Discussion of Background and Material Information

Conventional loudspeakers are typically composed of insulating supports screwed or riveted to the side of the loudspeaker bowl and include contacts designed to be connected on the one hand to the terminals of the motor and on the other to a suitable source of electrical current.

The installation of the insulating supports normally requires the use of special equipment in addition to being a time-consuming operation.

One of the purposes of the present invention is to provide a device to overcome these drawbacks and disadvantages.

SUMMARY OF THE INVENTION

An object of the present invention is to provide a connecting device which includes a body portion including a front side having at least one projection, two lateral sides, and forwardly extending arms attached to the body terminating in clamps adapted to engage an article, wherein the projection includes a bearing surface adapted to abut the article, and the clamps have shoulders adapted to engage corresponding elements of the article, and free ends terminating in wedge-shaped portions including opposite facing ramps. Preferably, the front side of the body is provided with two projections, each of which includes a bearing surface in addition to a stud located between these two projections. The bearing surfaces preferably form an acute angle with the front wall.

Another object of the present invention is to provide a connecting device, as previously described, which is adapted for connection with electrical apparatus wherein the body portion of the connecting device or connector includes a base and a rear wall thereby forming a socket, wherein the base is provided with at least two openings, the connector further including at least two elements of conductive material having a first section fitted in the openings and disposed within the socket and a second section extending outside the body, wherein the second section of the elements includes an end portion substantially perpendicular to the first section, which preferably includes an opening, such as a slot, adapted for attachment to an element of an electrical apparatus. The second section preferably also includes an intermediate portion substantially parallel to the first section. A second section of another of the elements is substantially parallel to the first section and is preferably provided with an intermediate portion having a projection cooperating with a slot in the base to retain the first section of the elements within the socket.

Another further object of the present invention is to provide a connection apparatus, as described above, wherein at least one of the lateral sides of the body is provided with at least one lateral arm extending in a plane substantially parallel to the front side of the body and preferably two parallel arms adapted to function as a grip.

Another still further object of the present invention is to provide a connection apparatus, as described above, wherein the rear wall of the body includes a recessed area and wherein the body further includes a panel interconnecting the front side and one of the lateral sides at an obtuse angle.

BRIEF DESCRIPTION OF THE DRAWINGS

The invention will now be desired in greater detail by reference to particular embodiments given by way of nonlimiting examples illustrated in the annexed drawings, in which.

DETAILED DESCRIPTION

The electrical connection apparatus according to the present invention is of the type which is designed for use with a loudspeaker including a vessel of the "salad bowl" type which supports a diaphragm, the side of which is provided with apertures. More specifically, the connector device is formed by a body made of an insulating material which is moulded to the required shape to form a socket designed to accommodate a male element. The socket contains at least two contact bars designed to be connected to the motor of the loudspeaker. A unique feature of the connector of the present invention is that the body is provided with at least one projection from a side adapted to function as a bearing surface designed to bear or abut against the side of the speaker bowl, at least two elastic clamps positioned on either side of the projection. Each of the clamps has a shoulder in the vicinity of its free end, the purpose of which is to engage or otherwise interact, as a result of elastic deformation experienced by the clamps, with the edges of corresponding opening in the bowl. Due at least in part to this arrangement, the connector device can be installed very rapidly and without the use of any special tools or equipment.

Related to this, in order to ensure that the connector device will be accurately centered, the body of the connector is fitted with a stud between the elastic clamps. According to one constructional feature, the free ends of the elastic clamps terminate in wedge-shaped portions, while the surfaces of the portions of the clamps which face towards each other constitute ramps. To install the device, therefore, all that is required is to place the electrical connector in the intended position and then exert a pressure so that it will be automatically fastened or snapped onto the bowl.

According to another embodiment of the present invention, the body of the connector includes at least two projections on a side wall. Each of these projections is provided with bearing face forming an acute angle with the side wall. In turn, the side wall has a prolongation situated in the plane of the bearing faces and delimited by two steps. The shoulders are situated in a plane parallel to a plane of the bearing faces. When the device has been placed in position, therefore, it is substantially parallel to the axis of the bowl. In addition, the connector body may include at least one lateral housing, formed by parallel arms, to accommodate a capacitor. Finally, according to another aspect of the invention, one of the side walls of the body of the electrical connector may be provided with two elastic tongues which, in conjuction with the wall in question, define the housing.

Figure 1:
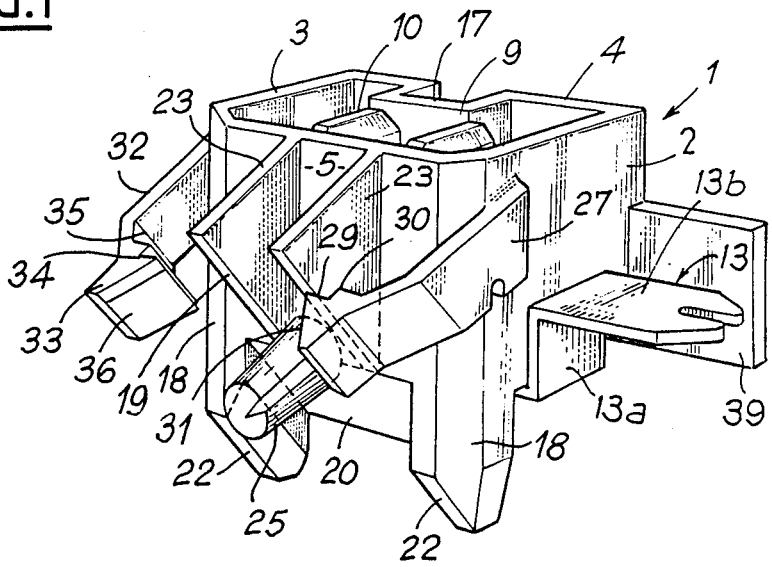
FIG. 1 is a perspective view of a device of the electrical connection of the motor of a loudspeaker.
Figure 2:
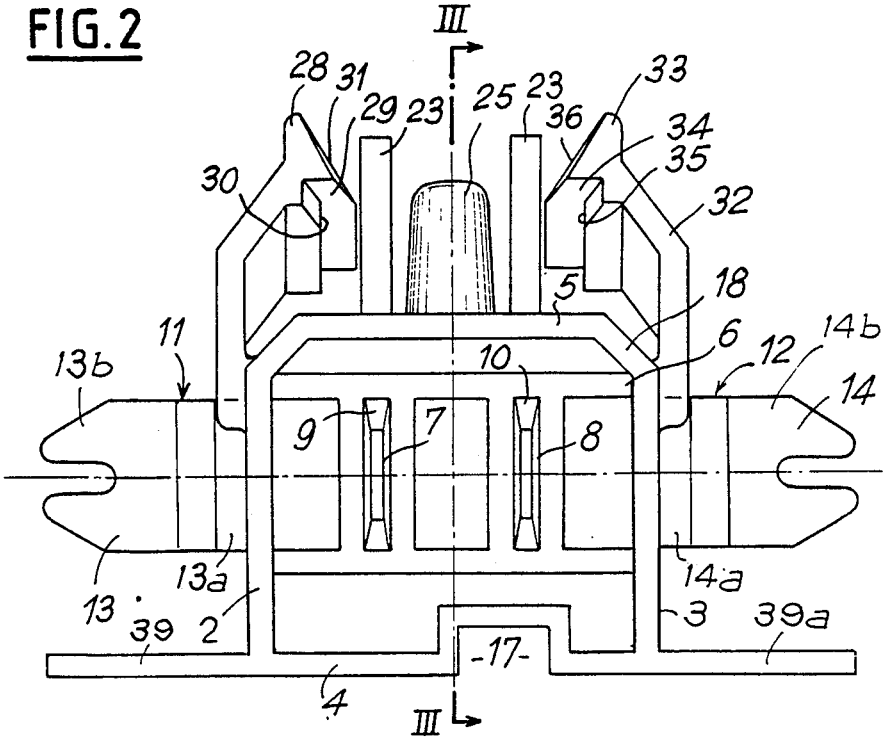
FIG. 2 is a plan view of the device shown in FIG. 1.
Figure 3:
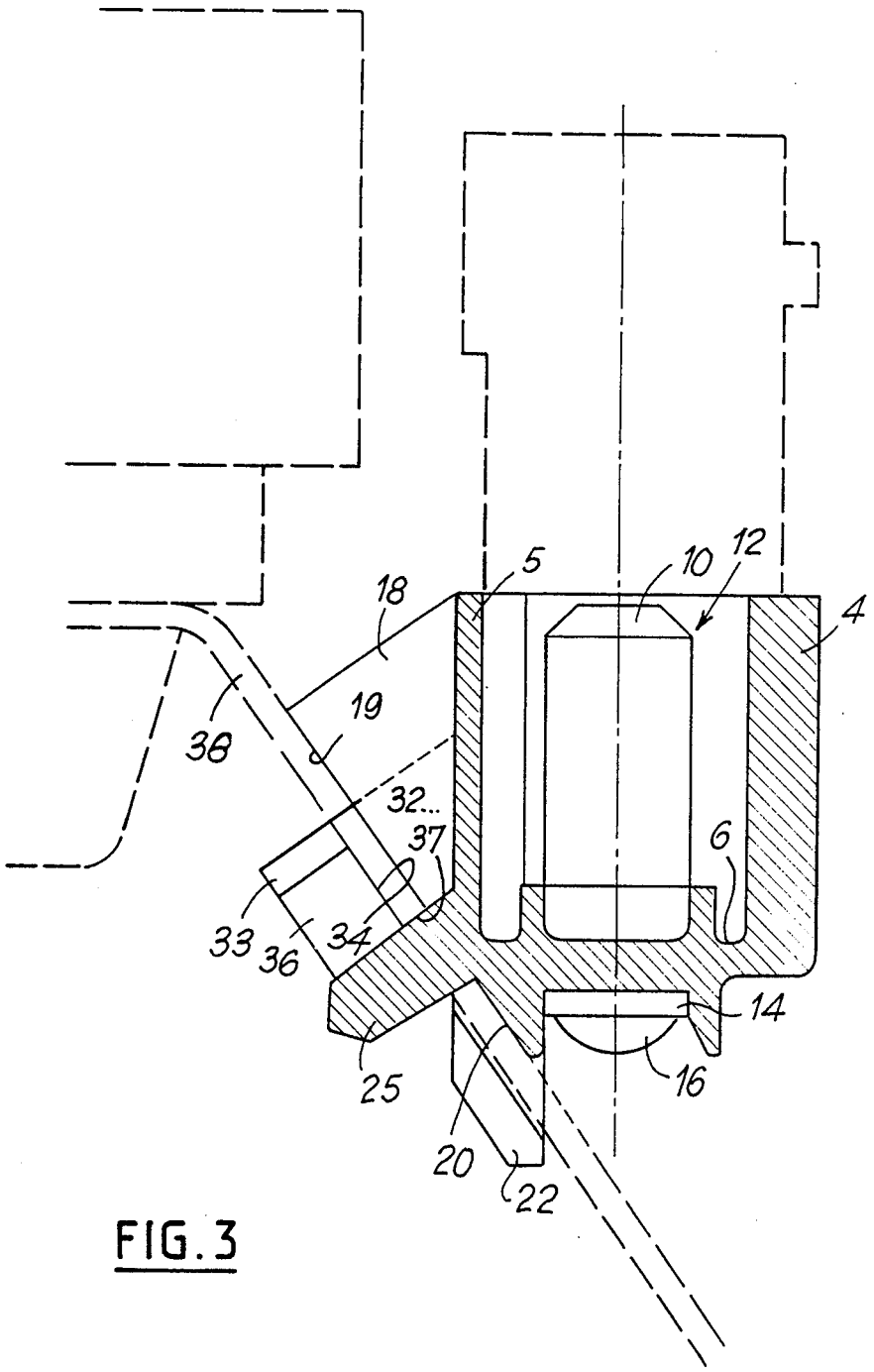
FIG. 3 is a section along the line III—III of FIG. 2.

Referring now more particularly to the drawings, the connection device of the present invention shown in FIGS. 1–3 includes a body 1 made of moulded plastic insulating material with side walls 2, 3, 4 and 5 and a base 6, such that the body 1 is in the form of a socket.

The base 6 is provided with two slits or slots 7 and 8. The slit 7 is traversed by a wing 9 of a bar 11 having the shape of an "L", while another wing 13 extends outside the wall 2 and includes a portion 13*a* substantially parallel to wing 9 and a portion 13*b* substantially perpendicualar to the aforementioned wing 9. The other slit 8 is traversed by a wing 10 of a bar 12 bent in the shape of an "L", the other wing 14 being situated outside the wall 3. The wing 14 is substantially identical to the wing 13 and includes corresponding portions 14*a* and 14*b*.

The bars 11 and 12 are preferably secured by studs provided on the outer surface of the base and passing through holes in the wings 13 and 14 of the bars and shaped in such a way as to provide heads 16 (as may be seen from FIG. 3).

The body 1 is designed to accommodate a male element having two female cavities designed to mate with the wings 9 and 10. To this end, body 1 is provided with a recess 17 and two panels 18 cut at an angle so that the male element can only be installed in one single angular position.

The side 5 is provided with two projections 23 which include two bearing surfaces 19. The side 5 also includes a prolongation 20 having the same angle of inclination as the bearing surfaces 19. The prolongation 20 is delimited by two steps 22, and a stud 25, having a shape of a truncated cone, extends between the prolongation 20 and the projections 23. The bearing surfaces 9 and the prolongation 20 form an acute angle with the side 5.

An elastic clamp 27 extends from the side 2 and terminates in a wedge-shaped portion 28 having a ramp 31, a shoulder 29 and a bearing surface 30; the shoulder 29 is substantially parallel to the bearing surface 19. In a similar manner, a clamp 32 extends from the side 3 and also terminates in a wedge-shaped end 33 having a ramp 26, a shoulder 34 and a bearing surface 35.

The wall 4 is provided on the side adjacent the wall 2 with a prolongation 39, while the side adjacent wall 3 is provided with a prolongation 39*a*. The purpose of prolongations 39 and 39*a* is to protect the wings 13 and 14, respectively.

The connection apparatus according to the present invention is adapted to be mounted on the bowl 38 of a loudspeaker, as shown in broken lines in FIG. 3. In this regard, the device is installed in such a manner that the supporting surfaces 19 and the prolongation 20 bear against the side wall of the loudspeaker bowl 38. In so doing, the stud 25 is inserted in a hole 37 of the speaker bowl and the connector device is secured in position by means of the elastic clamps. The speaker bowl is provided with apertures, and the clamps 27 and 32 enter these apertues and engage the internal surface of the bowl by means of their shoulders 29, while the supporting surfaces 30 and 35 bear against the edge of the apertures.

Needless to say, the edges of the apertures with which the bearing surfaces 30 and 35 engage are situated at a slightly greater distance apart than that present between the bearing surfaces 30 and 35, so that when the device is installed the ramps 31 and 36, by bearing against the corresponding edges of the apertures, cause the clamps 27 and 32 to move apart. The clamps 27 and 32 resume their initial position as soon as the ramps have moved beyond the thickness of the bowl. The wings 13 and 14 are designed with end slots or eyelets 13*e* and 14*e* adapted to be connected via suitable studs to the motor of the loudspeaker. When the connector device has been installed the connector extends parallel to the longitudinal axis of the bowl.

Thus, the operation of mounting the device into a speaker bowl (shown in phantom in FIG. 3) is relatively simple and straightforward and can be carried out rapidly and reliably without the use of any tool.

Figure 4:
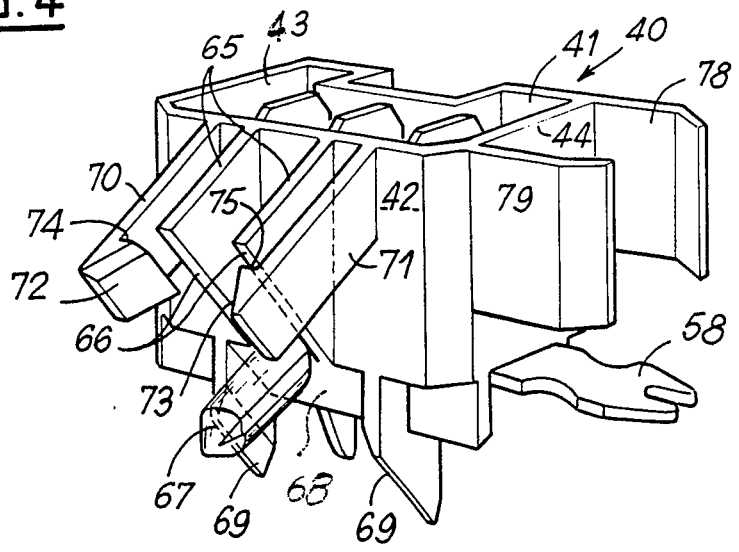
FIG. 4 is a perspective view of an alternative version of the device.
Figure 5:
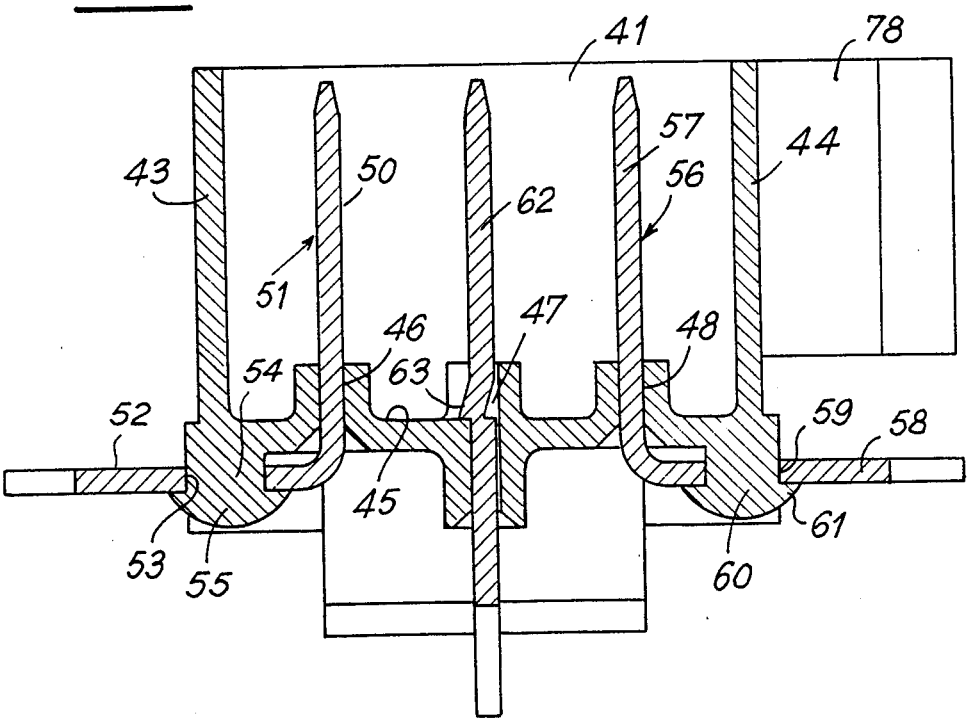
FIG. 5 is a longitudinal section through the device shown in FIG. 4.

FIGS. 4 and 5 show an alternative embodiment of the connection apparatus of the present invention in which the connector device includes a body 40 of moulded insulating plastic with four side walls 41, 42, 43 and 44 in addition to base 45. As in the previously described embodiment, the body 40 forms a socket designed to receive a corresponding male element. In this case, however, the base 45 has three slits or slots 47, 47 and 48, rather than merely two slots. A wing 50 of a bar 51, in the shape of an "L", is inserted in the slit 46. A lateral wing 52 of bar 51 is provided with an orifice 53 through which a stud 54, having a head 55 forming a means of securing the bar in position, is inserted. Another lateral wing 57 of a bar 56, also bent in the shape of an "L", is inserted into the slit 48 and another wing 58 of the bar is provided with an orifice 59 serving to accommodate a stud 60 terminating in a head 61 in a manner essentially the same as previously described. In this embodiment, however, a rectilinear bar 62 provided with a retaining lug 63 passes through the slit 47.

As in the previously described embodiment, the side 42 of the socket body is provided with two projections 65 with bearing surfaces 66 and prolongations 68 situated in substantially the same plane as the faces of bearing surfaces 66, a stud 67 and two elastic clamps 70 and 71. The clamps 70 and 71 terminate in wedge-shaped portions having ramps 72 and 73 and shoulders 74 and 75, respectively. In this embodiment, however, the side 44 is integral with two elastic tongues 78 and 79 forming a housing adapted to receive a capacitor, which may be elastically inserted between the tongues. The prolongation 68 is bordered by two stops 69.

The connector device shown in FIGS. 4 and 5 is mounted in substantially the same way as in the embodiment illustrated in the preceding drawings, i.e. the stud 67 engages a hole provided in the speaker bowl, while the faces 66 and the prolongations bear against the speaker bowl and the clamps 70 and 71 secure the system in position by means of their shoulder parts which rest against the bowl.

From the foregoing description, one skilled in the art can easily ascertain the essential characteristics of this invention and, without departing from the spirit and scope thereof, make various changes and modifications of the inventions to adapt to various usages and conditions.

What is claimed is:

1. An apparatus for electrical connection with a motor of an audio speaker, composed of a speaker bowl having a side provided with apertures and supporting a diaphragm, said apparatus comprising:

(a) a body including a side wall made of an insulating material and moulded into a shape of a socket adapted to receive a male element, said socket containing at least two contact bars adapted to be connected to the motor of said speaker;

(b) at least one projection from said side wall providing a bearing surface adapted to abut against a side of said speaker bowl; and (c) at least two elastic clamps including a shoulder attached to said body adapted to interact with edges of corresponding openings of said speaker bowl.

2. The apparatus for electrical connection in accordance with claim 1, wherein said body further comprises a stud extending from said body and positioned between said elastic clamps.

3. The apparatus for electrical connection in accordance with claim 1, wherein said free ends of said elastic clamps terminate in wedge-shaped portions including opposite facing ramps.

4. The apparatus for electrical connection in accordance with claim 1, wherein said body comprises at least two projections on said side wall, each of said projections having a bearing surface forming an acute angle with said side wall of said speaker bowl, said side wall having a lower extended portion situated in the plane of each of the bearing faces and being delimited by two stops, wherein each said shoulder is situated in a plane parallel to a plane of said bearing faces.

5. The apparatus for electrical connection in accordance with claim 1, wherein said body further comprises at least one lateral housing.

6. The apparatus for electrical connection in accordance with claim 5, wherein at least one lateral side of said body comprises two elastic tongues forming said housing.

7. A connection apparatus comprising:

(a) a body portion including a front side having at least one projection, two lateral sides, and forwardly extending arms attached to said body terminating in clamps adapted to engage an article.

8. The connection apparatus according to claim 7, wherein said projection includes a bearing surface adapted to abut said article.

9. The connection apparatus according to claim 8, wherein said clamps have shoulders adapted to engage said article.

10. The connection apparatus according to claim 9, wherein said clamps have free ends terminating in wedge-shaped portions.

11. The connection apparatus according to claim 10, wherein said wedge-shaped portions include opposite facing ramps.

12. The connection apparatus according to claim 8, wherein said front side of said body has two projections, each of said projections including a said bearing surface.

13. The connection apparatus according to claim 12, wherein said front side of said body is provided with a stud located between said two projections.

14. The connection apparatus according to claim 12, wherein each said bearing surface forms an acute angle with said front side.

15. The connection apparatus according to claim 14, wherein said front side has a lower position extending rearwardly at an obtuse angle of inclination with respect to said front wall in the same plane as said bearing surface.

16. The connection apparatus according to claim 15, wherein said obtuse angle of inclination is complementary to said acute angle.

17. The connection apparatus according to claim 7, wherein said body portion includes a base and a rear wall thereby forming a socket.

18. The connection apparatus according to claim 17, further comprising at least two elements of conductive material wherein said base is provided with at least two openings, said elements of conductive material having a first section fitted in said opening and disposed in said socket.

19. The connection apparatus according to claim 18, wherein said elements have a second section extending outside said body.

20. The connection apparatus according to claim 19, wherein said second section of two of said elements include an end portion substantially perpendicular to said first section.

21. The connection apparatus according to claim 20, wherein said end portion includes an opening adapted for attachment to an element of an electrical apparatus.

22. The connection apparatus according to claim 21, wherein said opening is a slot in said end portion.

23. The connection apparatus according to claim 20, wherein said second section includes an intermediate portion substantially parallel to said first section.

24. The connection apparatus according to claim 20, wherein said second section of another of said elements is substantially parallel to said first section.

25. The connection apparatus according to claim 24, wherein said another of said elements has an intermediate section provided with a projection cooperating with said slot to retain said first section of said another of said elements within said socket.

26. The connection apparatus according to claim 25, wherein said another of said elements is a rectilinear bar.

27. The connection apparatus according to claim 7, wherein at least one of said lateral sides is provided with at least one lateral arm extending in a plane parallel to said front side.

28. The connection apparatus according to claim 22, wherein at least one of said lateral sides is provided with two lateral arms extending in planes substantially parallel to said front side adapted to function as a grip.

29. The connection apparatus according to claim 16, wherein said rear wall includes a recessed area.

30. The connection apparatus according to claim 29, wherein said body further comprises a panel interconnecting said front side and one of said lateral sides at an obtuse angle.

31. An electrical connector comprising:

(a) a body portion including (i) a front face having at least one projection;

(ii) two lateral sides connected to said front face;

(iii) a rear wall interconnecting said lateral side; and (iv) a base on which said front face, said lateral sides and said rear wall are mounted, thereby defining a socket; and (b) at least two arms extending from said body; and (c) at least two elements of conductive material fitted in said socket.

32. The electrical connector according to the claim 31, wherein said base is provided with at least two openings, and said elements of conductive material have a first section fitted in said opeing and disposed in said socket.

33. The electrical connector according to claim 32, wherein said elements have a second section extending outside said body.

34. The electrical connector according to claim 33, wherein said second section of two of said elements include an end portion substantially perpendicular to said first section.

35. The electrical connector according to claim 34, wherein said end portion includes an opening adapted for attachment to an element of electrical apparatus.

36. The electrical connector according to claim 35, wherein said opening is a slot in said end portion.

37. The electrical connector according to claim 36, wherein said second section includes an intermediate portion substantially parallel to said first section.

38. The electrical connector according to claim 37, wherein said second section of another of said elements is substantially parallel to said first section.

39. The electrical connector according to claim 38, wherein said another of said elements has an intermediate section provided with a projection cooperating with said slot to retain said first section of said another of said elements within said socket.

40. The electrical connector according to claim 31, wherein said projection includes a bearing surface adapted to abut said article.

41. The electrical connector according to claim 40, wherein said front side of said body has two projections, each of said projections including a said bearing surface.

42. The electrical connector according to claim 41, wherein said front side of said body is provided with a stud located between said two projections.

43. The electrical connector according to claim 42, wherein each said bearing surface forms an acute angle with said front wall.

44. The electrical connector according to claim 43, wherein said front wall has a lower portion extending rearwardly at an obtuse angle of inclination with respect to said front wall.

45. The electrical connector according to claim 44, wherein said obtuse angle of inclination is complementary to said acute angle.

46. The electrical connector according to claim 45, wherein said rear wall includes a recessed area.

47. The electrical connector according to claim 46, wherein said body further comprises a panel interconnecting said front side and one of said lateral sides at an obtuse angle.

48. The electrical connector according to claim 47 wherein said arms including forwardly extending clamps attach to said body.

49. The electrical connector according to claim 48, wherein said clamps have shoulders adapted to engage corresponding elements of said article.

50. The electrical connector according to claim 49, wherein said clamps have free ends terminating in wedge-shaped portions.

51. The electrical connector according to claim 50, wherein said wedge-shaped portions include opposite facing ramps.

52. The electrical connector according to claim 31, wherein said elements have one end connected to a source of electric current.

53. The electrical connector according to claim 52, wherein two of said elements have another end connected to a motor of an audio speaker.

* * * * *